US009840817B2

(12) United States Patent
Wallinder

(10) Patent No.: US 9,840,817 B2
(45) Date of Patent: Dec. 12, 2017

(54) ROAD MODULE FOR REGULATION OF VEHICLE PASSABILITY AT A ROAD SECTION

(75) Inventor: Jonas Wallinder, Vreta Kloster (SE)

(73) Assignee: EDEVA AB, Linköping (SE)

( * ) Notice: Subject to any disclaimer, the term of this patent is extended or adjusted under 35 U.S.C. 154(b) by 516 days.

(21) Appl. No.: 13/882,074

(22) PCT Filed: Oct. 24, 2011

(86) PCT No.: PCT/SE2011/051259
§ 371 (c)(1),
(2), (4) Date: Apr. 26, 2013

(87) PCT Pub. No.: WO2012/057679
PCT Pub. Date: May 3, 2012

(65) Prior Publication Data

US 2013/0216305 A1 Aug. 22, 2013

(30) Foreign Application Priority Data

Oct. 26, 2010 (SE) ..... 1001054

(51) Int. Cl.
*E01F 11/00* (2006.01)
*E01F 9/529* (2016.01)

(52) U.S. Cl.
CPC ..... *E01F 9/529* (2016.02)

(58) Field of Classification Search
None
See application file for complete search history.

(56) References Cited

U.S. PATENT DOCUMENTS

| | | | | |
|---|---|---|---|---|
| 3,838,391 | A | 9/1974 | Mintz | |
| 5,509,753 | A | 4/1996 | Thompson | |
| 6,398,452 | B1 * | 6/2002 | Wagner et al. | 404/6 |
| 7,001,099 | B2 * | 2/2006 | Rittenhouse et al. | 404/6 |
| 2007/0237577 | A1 * | 10/2007 | Gelfand et al. | 404/6 |

FOREIGN PATENT DOCUMENTS

| | | | |
|---|---|---|---|
| DE | 548950 | A | 3/1937 |
| GB | 2333114 | A | 7/1999 |

OTHER PUBLICATIONS

PCT/ISA/210—International Search Report—dated Feb. 3, 2012 (Issued in PCT/SE2011/051259).

* cited by examiner

*Primary Examiner* — Thomas B Will
*Assistant Examiner* — Katherine Chu
(74) *Attorney, Agent, or Firm* — Venable, LLP; Jeffri A. Kaminski

(57) ABSTRACT

A road module for regulating a passability of vehicles on a roadway. The road module includes an elongated container immersed across the roadway and having an upper plane being essentially at level with the roadway. A lid is pivotally arranged and hinged along an edge of the container. The edge extends along a longitudinal side of the container facing vehicles approaching the road module. The lid forms at least a part of the upper plane of the container. An eccentrically mounted cylindrical roller is configured to support the lid at an opposite longitudinal side of the container. The roller is rotatable between an upper or a lower position. An actuator is configured to rotate the roller to lower and raise the lid, thereby forming a downward ramp in a passing direction of the vehicles when the roller is in the lower position.

10 Claims, 2 Drawing Sheets

ROAD MODULE FOR REGULATION OF VEHICLE PASSABILITY AT A ROAD SECTION

CROSS-REFERENCE TO RELATED APPLICATIONS

This application claims priority to Swedish patent application 1001054-4 filed 26 Oct. 2010 and is the national phase under 35 U.S.C. §371 of PCT/SE2011/051259 filed 24 Oct. 2011.

TECHNICAL FIELD

The present invention relates to a device located in a roadway intended for vehicles. The device is set up to influence incoming vehicles driving contrary to regulations for a road section. Passengers in the vehicle are affected in an unpleasant way, for instance as a result of mechanical stress caused by this device. A device of this kind is usually termed high-speed restricting device, or speed bump, but may be used for other purposes.

BACKGROUND ART

To affect drivers of vehicles to reduce speed at places like pedestrian crossings beyond the threat of fines it is known to use high-speed restricting devices. In its simplest form a high-speed restricting device consisting of a raised portion of the road, a so called road bump, can be used. A speeding vehicle crossing the bump is affected in a disturbing way. A disadvantage with this kind of device is that a vehicle crossing the bump at legal speed is affected in the same disturbing way. To avoid this, high-speed restricting devices have been developed, where the device raises a lid, a ramp or something similar, when a vehicle approaches the high-speed restricting device too fast. Vehicles driven by legal speed will not be affected by the high-speed restricting device. However, said restricting device is not only passed by cars but also by heavy trucks and industrial vehicles. The strain on the moving mechanics of the high-speed restricting device may be considerable, which means that known high-speed restricting devices with moving parts have proven to be short-lived and injury-prone. These known high-speed restricting devices are also exposed to effects from weather, sand and gravel.

GB 2333114 presents a high-speed restricting device comprising a contact plate held level with the road surface by a latch mechanism. At too high detected speed the latch is opened and the contact plate can be pressed down by a wheel of a traversing vehicle that receives a jolt when hitting an edge in front of the contact plate. When the vehicle has passed, a counter weight is expected to raise the plate again. If the plate would jam, a latch on the counter weight raises and is pressed down by the rear wheels or another vehicle. If a lorry with many axles would pass, the contact plate will be exposed to a considerable amount of activity.

BRIEF DESCRIPTION OF THE INVENTION

The invention presents a road module intended to be immersed in the roadway on a road section. The road module is of a robust construction so that it will not be subjected to powerful forces, when heavy vehicles pass the road module or are left standing on it. The road module is intended to only affect vehicles in breach of the provisions for passability in the section of the road. Vehicles that meet the requirements for passability are not exposed to any inconvenience.

According to one aspect of the invention a device with the characteristics in accordance with the independent claim 1 is presented.

Additional aspects of the invention are presented in the dependant patent claims.

In accordance with the invention the road module is comprised of a container intended to be immersed in the roadway across the direction of travel for vehicles using the roadway. The container is elongated and has an upper plane substantially level with the road way. Viewed from the driving direction of the vehicles over the container, the container has a rear wall facing approaching vehicles on the roadway and an opposing front wall.

A swivelling lid is pivoted at the rear wall of the elongated container.

Along the front wall, the lid rests upon an eccentrically mounted cylindrical roller whose cross section is preferably circular. The lid can rotate around its suspension and be controlled to be lowered at the end where the lid rests on the roller, whereby a downward sloping ramp can be achieved in the roadway.

A significant advantage with the road module according to the invention is that large dynamic loads that arise when a vehicle passes the road module when the lid 2 is in its lowered position, are transferred to the container. Only vertical forces from vehicles passing over the lid of the road module are transferred to the roller and its bearing. Essentially no forces are passed on to transmissions and actuators, thus giving the road module a long life compared to previously known technical solutions of similar structure.

Further advantages and characteristics are shown in the below description of a road module in accordance with the invention.

A seal between the outer edges of the lid and the container walls implicates that particles from above, such as sand, rain, gravel and snow are prevented from entering and endangering the function of the road module.

LIST OF DRAWINGS

FIG. 1 schematically shows a cross section of a road module according to the invention where the front lid is in its upper position.

FIG. 2 schematically and correspondingly shows the road module according to FIG. 1 in a cross section with the front edge of the lid in the lower position, whereby a downward sloping ramp in the road surface is created.

DESCRIPTION OF EMBODIMENTS

For realization of the invention a number of examples of embodiments are given in the following description with support of the attached figures.

Figure 4:
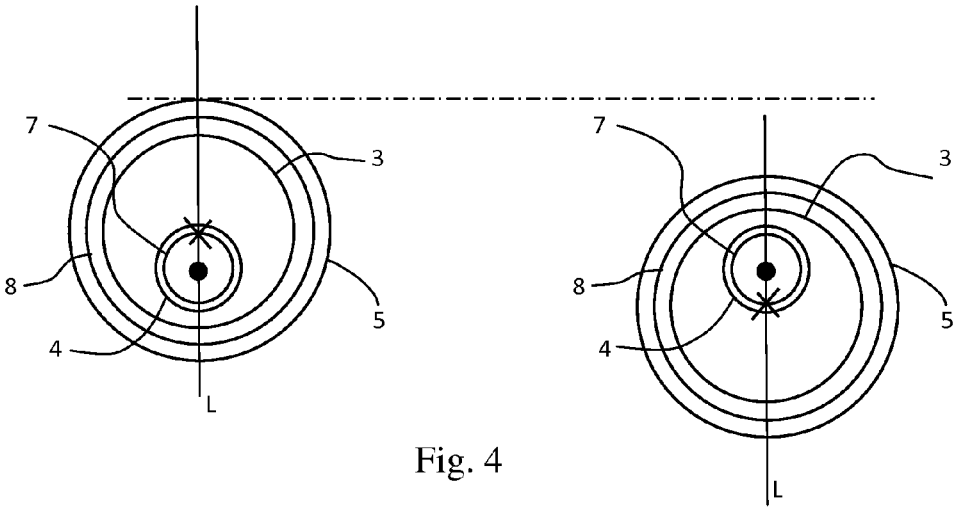
FIG. 4 shows an enlargement of the roller, a shell, a bearing between these, and a shaft pivot and their relative positions in order to clarify these components.

The design of the invention as shown in the drawings displays a container-like body hereafter referred to as container 1. Said container 1 is intended to be immersed in the ground and preferably cast in the roadway to withstand the high forces that can occur and caused by heavy traffic traversing the container. The uppermost plane of the container 1 is suitably placed at level with the surface of the roadway where the road module is situated. At the upper plane of the container 1 is a lid 2 with its rear edge rotatably mounted along the inner edge 6 of the rear wall, i.e. on the long side of the container 1 that is turned towards approaching vehicles. At the opposite wall of the container 1, the front wall, and along the inside of said front wall, a beam 6*b* is mounted to pick up loads from passing vehicles to transfer the loads to the container 1, when the lid 2 is in its lower position. To carry the lid 2 at the end of the container 1, where the beam 6*b* is arranged, a roller 3 is set up along the front wall of the container 1. Here it should also be mentioned that the roller 3 can be divided into roller sections, or consist of more than one roller. The front edge of the lid 2 rests on the roller 3, which means that the roller 3 supports the lid 2 and transfer charges affecting the front edge of the lid 2 (i.e. the edge of the lid that is turned in the same direction as the vehicle direction of travel across the lid 2). The roller 3 has at both ends shaft pivots 7 set up in an eccentrically running axis through the cylindrical roller 3. The shaft pivots 7 are marked with a filled point in FIG. 4. The shaft pivots 7 are in turn mounted in the container 1 by use of ball bearings or slide bearings (marked with number 4 in the figures). If, according to one embodiment, the roller 3 is constituted of multiple roller sections, the roller 3 may have a shaft 7 running through and common to all roller sections.

The lid 2 is rotatably mounted with its rear edge at the rear wall of the container 1, so that the rear edge of lid 2 connects to the rear end 6 of the container. The lid 2 is rotatably mounted in a shaft 9, enabling its front edge to rotate upwards or downwards. In its upper position the front edge of lid 2 rests on roller 3, so that the lid is kept at level with the upper plane of the container 1. When the module is activated, roller 3 is rotated so that lid 2 rotates, which means that the lid, through its own weight, contacts a shell 5 regardless of the rotational position of the roller. This is described in more detail in FIG. 4. Here, the left picture shows the position of roller 3 at the upper position of lid 2, when shell 5 of the roller keeps lid 2 at the level shown by the point dashed line. The eccentric mounting centre of the roller is illustrated with a solid point, while the centre axis of the roller is illustrated by a cross. Thus it is clear that the centre axis of the roller is located vertically above the mounting centre of the roller in its upper position. This is shown by the vertical line L. All the weight of lid 2, and vertical loads from passing vehicles will obviously be transferred to the shaft and bearings in the mounting centre and cannot be transferred to transmission systems and actuators. In the right picture, the roller has been rotated by the actuator 11 to its lower position. The centre of rotation is marked by the filled point, which means that the centre axis of roller 3 now is directly below the eccentric mounting centre of roller 3. This is shown by the cross which is now on vertical line L below the mounting centre. Even in this situation it is clear that all vertical loads from lid 2 are transferred only to shaft and bearings in the bearing centre. When a vehicle has activated the module on passing, lid 2 flips back to its initial position as the roller again rotates to its initial position. The rotation of the roller can advantageously always be in the same direction and the stopping of the rotary motion of the roller controlled by position sensors. The initial position of the roller can be the lower position as well as the upper position.

Figure 1:
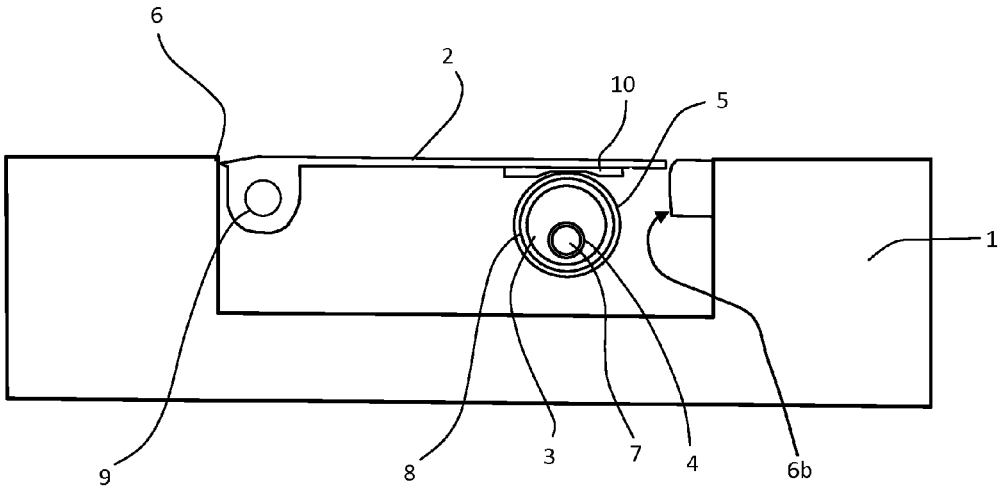
Figure 2:
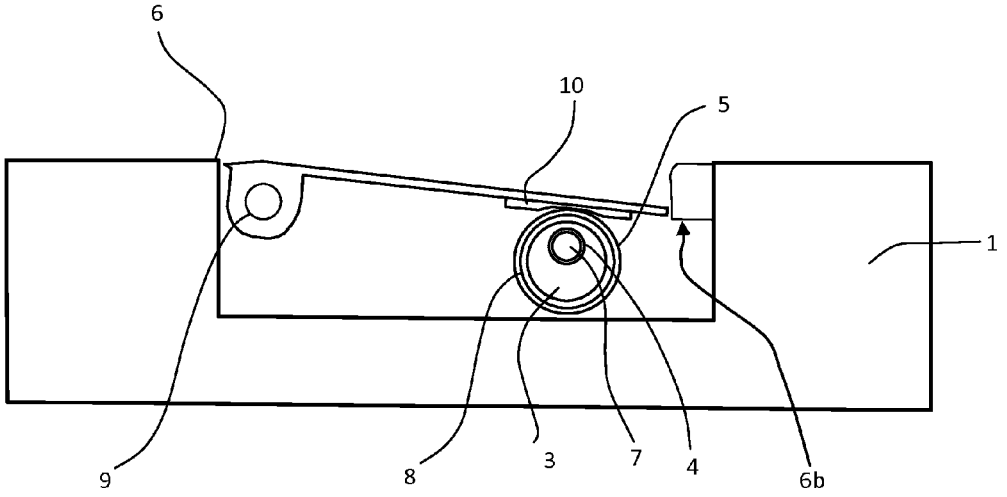
Figure 3:
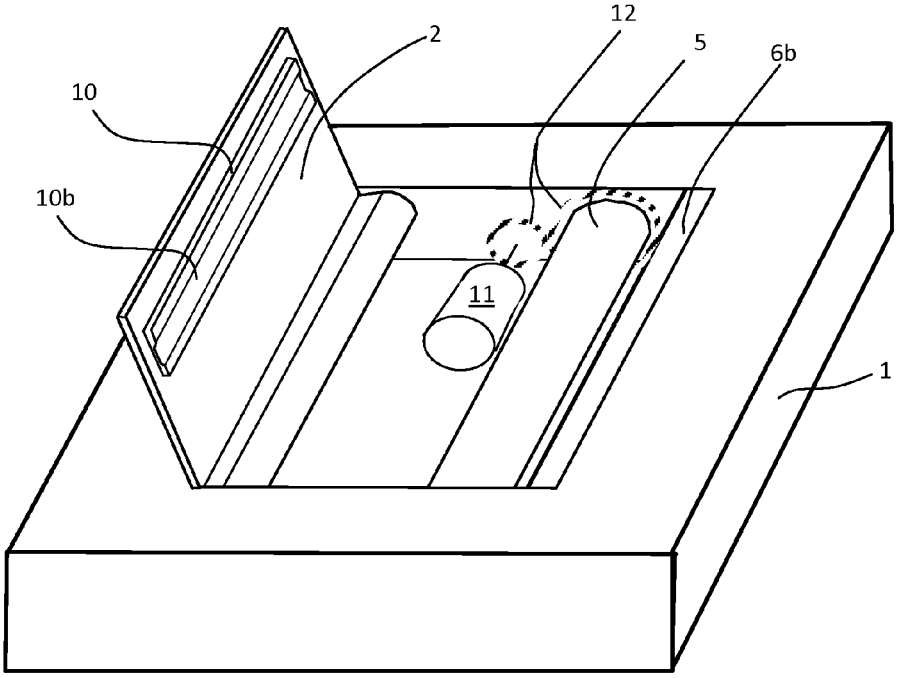
FIG. 3 illustrates the road module in a perspective view with the lid over the container opened so that its interior is shown.

Furthermore, in container 1 actuators and some kind of transmission are arranged for the transfer of rotational motion to roller 3 when the road module is activated or returns to its initial position. The transmission and the actuator can be designed in numerous ways and they are here only briefly described. A variant is shown in FIG. 3 where an actuator is denoted by 11 and power transfer gears are symbolically demonstrated and denoted by 12. Position sensors are fitted to convey the rotational position of roller 3 so that the rotation of roller 3 can be interrupted when the lid 2 is in its upper or lower position.

On the roller 3 a cylindrical shell 5 is mounted in a bearing 8, which can be a ball bearing or a slide bearing so that the shell 5 can roll against the bottom side of the lid 2 at the rotation of roller 3. This stops shell 5 from sliding and rubbing against the bottom side of the lid. The exterior surface of the shell 5 may be coated with an elastic coating. The coating may be composed of rubber, an elastic plastic or other elastic or resilient material.

An inflatable stop prevents the lid from throw open and allows the lid to be swung up for service inspection. At service inspection the lid is swung up so that its centre of gravity lands on the other side of bearing 9, whereby its own weight keeps the lid in the open position (for example by means of a lip that can be swung in and out). For safety reason, there is also a latch on each side of lid 2 to lock it in the open position. The bottom side of the lid 2 can be fitted with an elastic coating 10 at the location of the roller's 3 contact with the lid 2. Coating 10 can be made of rubber, an elastic plastic or other elastic or resilient material. The coating contributes to reduced wear of the lid and the roller at the same time as it contributes to a reduction in noise level when lid 2, for example, creates a clattering movement against roller 3 when vehicles pass. The coating 10 may be flat or, preferably, as shown in the figures, designed with a longitudinal groove 10*b*. At the lifting end of the lid there are lips and other assistance organized for the module to be mechanically locked in its upper position, independent of other functions of the module.

At the front edge of the container it is possible to arrange a display with reflecting means or lights which are visible when the lid 2 is in the lower position. The wheels of the vehicles passing the road module, when the lid is in its lower position, will not be in contact with the display or reflecting means as the edge of the beam 6*b* and lid 2 forms an acute angle and the diameter of the wheels in relation to the depth of the module is large. In addition, the display may be arranged slightly recessed into the surface of beam 6*b*.

Sealings can be arranged between the inside of container 1 and the edge of lid 2.

A control module is set up to handle signals to and from the road module and/or other external units, for example an active road sign. One or more measuring modules are designed to send signals to the control module, for example the speed of approaching vehicles.

Alternatively, lid 2 of the road module is arranged to normally occupy its lower position and that the above mentioned display lights up and warns approaching vehicles in breach of the rules for passability. According to this alternative, when a vehicle is passing in accordance with speed restrictions, the road module changes its state, wherein the lid 2 is at level with the roadway section with the display being obscured and/or switched off.

Actuator 11 is preferably provided with some form of overload protection, torque limitation, torque limiting coupling or current limit that prevents the road module from trying to raise or lower lid 2 if the load is too heavy, for example when a vehicle passes when the roller is in motion. The centre axis of the eccentrically mounted roller is substantially located above respectively below the centre of rotation for the stationary positions which means that normally the torsional forces which affect the roller both in upper and lower position will be insignificant. This spares the actuator 11 and the power transmission and prolongs the life of the road module.

The road module can be exploited in several ways other than in connection with activation when a vehicle violates permitted speed restrictions for the section of the road. It can for example be used to restrict passability for certain types of vehicles.

The invention claimed is:

1. A road module for regulating a passability of vehicles on a roadway, the road module comprising:

an elongated container immersed across the roadway and having an upper plane being essentially at level with the roadway, a lid pivotally arranged and hinged along an edge of the container, and said edge extending along a longitudinal side of the container facing vehicles approaching the road module, wherein the lid forms at least a part of the upper plane of the container, an eccentrically mounted cylindrical roller comprising a shell configured to support the lid at an opposite longitudinal side of the container, such that the lid contacts and rests on the shell of the roller, wherein the roller is rotatable between an upper or a lower position, such that in the upper position and in the lower position a longitudinal axis and an axis of rotation of the eccentrically mounted cylinder roller are vertically aligned, and an actuator configured to rotate the roller to lower and raise the lid, thereby forming a downward ramp in a passing direction of the vehicles when the roller is in the lower position, such that the lid and the eccentrically mounted cylindrical roller are subjected to vertical forces of a weight of a vehicle when the lid is lowered or raised, wherein dynamic loads are transferred to the container when the lid is lowered.

2. The road module according to claim 1, further comprising:

a shaft on which the roller is eccentrically mounted in a bearing, wherein a center axis of the roller, both in the upper position, where the roller supports the lid at level with the upper plane of the container and in the lower position where the roller supports the lid in a lowered position, is arranged to essentially be in a vertical line above or below the shaft.

3. The road module according to claim 1, wherein the shell of the roller can rotate around a periphery of the cylindrical roller.

4. The road module according to claim 1, wherein an external surface of the shell of the roller and an underside of the lid are separated by an elastic coating.

5. The road module according to claim 1, wherein a region of the lid abutting the shell of the roller comprises an elastic coating.

6. The road module according to claim 1, further comprising:

position sensors arranged so as to cause the roller to be placed into a rotational position corresponding to a position where the lid abuts the roller at a point on the shell of the roller which has a longest distance to the center of the eccentric shaft of the roller, and at a point of the roller that has the shortest distance to the eccentric shaft of the roller, respectively.

7. The road module according to claim 1, wherein the lid at a contact area against the roller comprises a longitudinal groove directed towards the shell of the roller, whereby said groove contributes to stabilize the rotational position of roller in a fully raised or a fully lowered position.

8. The road module according to claim 1, where lid is movable to swing up, so that an interior of the container is accessible.

9. The road module according to claim 8, wherein the interior of the container is accessible when maintenance is required.

10. The road module according to claim 4, wherein the elastic coating comprises at least one of rubber or an elastic plastic.

* * * * *